US006817039B1

(12) United States Patent
Grilliot et al.

(10) Patent No.: US 6,817,039 B1
(45) Date of Patent: Nov. 16, 2004

(54) PROTECTIVE HELMET, SUCH AS FIREFIGHTER'S HELMET, WITH INNER PADS

(75) Inventors: William L. Grilliot, Dayton, OH (US); Mary I. Grilliot, Dayton, OH (US); Thomas H. Stachler, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 10/732,754

(22) Filed: Dec. 10, 2003

(51) Int. Cl.[7] ..... A42B 3/00
(52) U.S. Cl. ..... 2/413; 2/414; 2/416; 2/DIG. 3
(58) Field of Search ..... 2/411, 412, 414, 2/416, 420, 413, DIG. 3

(56) References Cited

U.S. PATENT DOCUMENTS 2,759,186 A * 8/1956 Dye ..... 2/413
3,613,113 A * 10/1971 Aileo ..... 2/420
3,668,704 A * 6/1972 Conroy et al. ..... 2/413
3,806,950 A * 4/1974 Spencer-Foote ..... 2/413
3,859,666 A * 1/1975 Marietta et al. ..... 2/412
3,943,572 A * 3/1976 Aileo ..... 2/415
4,354,283 A * 10/1982 Gooding ..... 2/413
4,833,735 A * 5/1989 Long et al. ..... 2/419
5,121,508 A 6/1992 Grilliot et al.
5,517,691 A * 5/1996 Blake ..... 2/5
5,774,900 A * 7/1998 Wu et al. ..... 2/411
5,996,126 A * 12/1999 Barthold et al. ..... 2/414

* cited by examiner

*Primary Examiner*—Rodney M. Lindsey
(74) *Attorney, Agent, or Firm*—Wood, Phillips, Katz, Clark & Mortimer

(57) ABSTRACT

In a protective helmet comprising a rigid shell having a lower periphery and a suspension system, which may have two crossed straps mounted within the rigid shell, at spaced intervals around a lower periphery of the rigid shell, an array of inflatable pads is carried by the suspension system, within the rigid shell, above the lower periphery. The inflatable pads are joined by and between two fabric sheets. If the suspension system has two crossed straps, as preferred, some of the inflatable pads are disposed directly below the crossed straps, between a central region of the rigid shell and the lower periphery, while another of the inflatable pads is disposed in the central region. The crossed straps may extend through slits in the fabric sheets. The respective pads are inflated with a suitable gas, such as air, with a suitable liquid, such as water, with a suitable foam, or with a suitable gel.

9 Claims, 1 Drawing Sheet

PROTECTIVE HELMET, SUCH AS FIREFIGHTER'S HELMET, WITH INNER PADS

TECHNICAL FIELD OF THE INVENTION

This invention pertains to a protective helmet, such as a firefighter's helmet, and contemplates that the protective helmet has inflatable pads, which function primarily to provide cushioning between a suspension system and a wearer's head.

BACKGROUND OF THE INVENTION

In U.S. Pat. No. 5,121,508, the disclosure of which herein is incorporated by reference, a firefighter's helmet is disclosed, which has a suspension system functioning primarily to fit the firefighter's helmet on a firefighter's head. The suspension system comprises a head band, a single, non-inflatable pad, which is disposed in a central region within the firefighter's helmet, and plural straps, which extend between the head band and the single pad.

In U.S. patent application Ser. No. 10/718,276, which was filed on Nov. 20, 2003, which is entitled BLADDER MADE FROM FLAME-RESISTANT FABRIC AND FROM FLUID-IMPERVIOUS FILM, and the disclosure of which herein is incorporated by reference, an inflatable bladder is disclosed, which is made from a flame-resistant fabric and from a fluid-impervious film, so as to be advantageously useful in an application involving a firefighter's garment.

SUMMARY OF THE INVENTION

This invention provides a protective helmet comprising a rigid shell, which has a central region and a lower periphery, a suspension system, which is mounted within the rigid shell and which is adapted to suspend the protective helmet on a wearer's head, and an array of inflatable pads, which are carried by the suspension system, between the central region and the outer periphery, and which are adapted to provide cushioning between the suspension system and the wearer's head. The suspension system functions primarily to fit the protective helmet on the wearer's head and the array of inflatable pads functions primarily to provide cushioning between the suspension system and the wearer's head.

Preferably, the suspension system has straps mounted within the rigid shell, at spaced intervals around a lower periphery of the rigid shell, each strap extending downwardly and outwardly toward the outer periphery and extending oppositely toward a central region within the rigid shell. Preferably, moreover, the array of inflatable pads includes inflatable pads disposed between the straps, between the central region and the lower periphery. The array of inflatable pads, also, may include an inflatable pad disposed in the central region. Alternatively, the suspension system may comprise a fabric or mesh material, which is shaped so as to conform generally to a wearer's head.

Preferably, each pad contains an inflatable bladder. Preferably, the inflatable pads are joined by a fabric sheet. Preferably, the fabric sheet has slits, through which the straps extend. In a preferred embodiment, the inflatable pads are joined by and between two fabric sheets having slits, through which the straps extend. In the preferred embodiment, the straps are comprised of two crossed straps, which cross in the central region.

Although intended for a firefighter's helmet, this invention is expected to be also useful for a protective helmet of any of a variety of other types, such as a protective helmet for a rescuer worker, for an oilfield worker, for a construction worker, for a miner, or for a motorcyclist, or a military helmet.

DETAILED DESCRIPTION OF THE ILLUSTRATED EMBODIMENT

Figure 1:
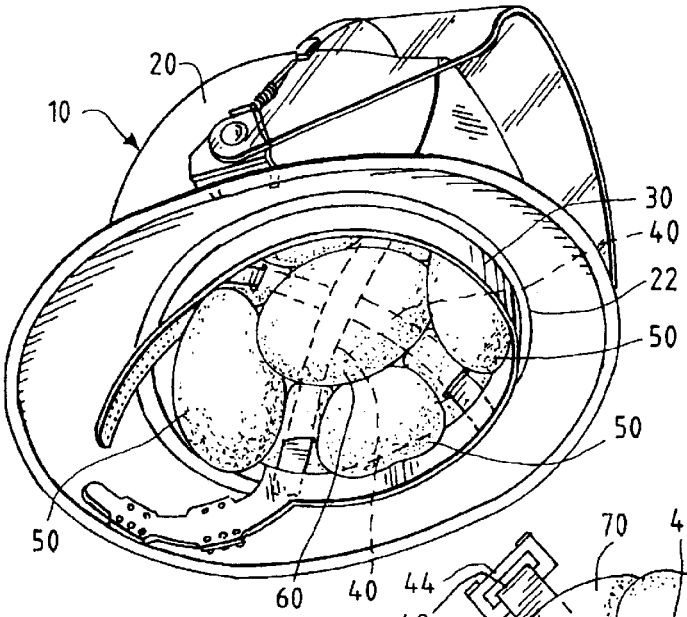
FIG. 1, which is adapted from FIG. 9 of U.S. Pat. No. 5,121,508, supra, is a perspective view looking upwardly into a firefighter's helmet embodying this invention.
Figure 2:
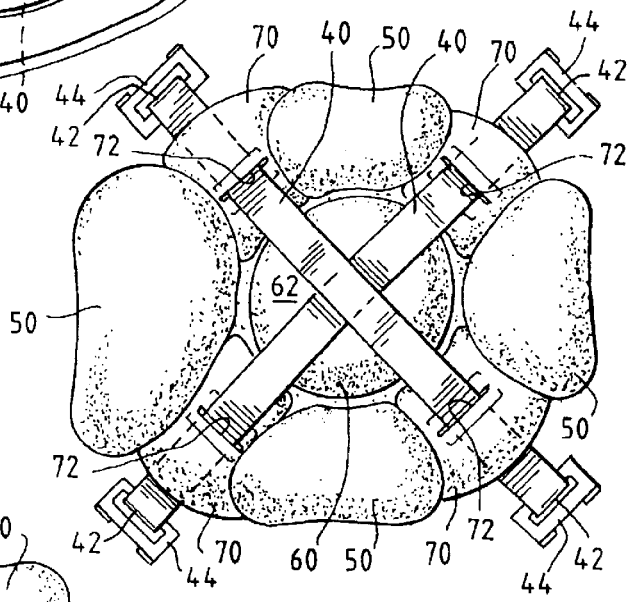
FIG. 2 is an upper, plan view of a suspension system having, as preferred, two crossed straps and of an array of inflated pads joined by the crossed straps, apart from the firefighter's helmet.
Figure 3:
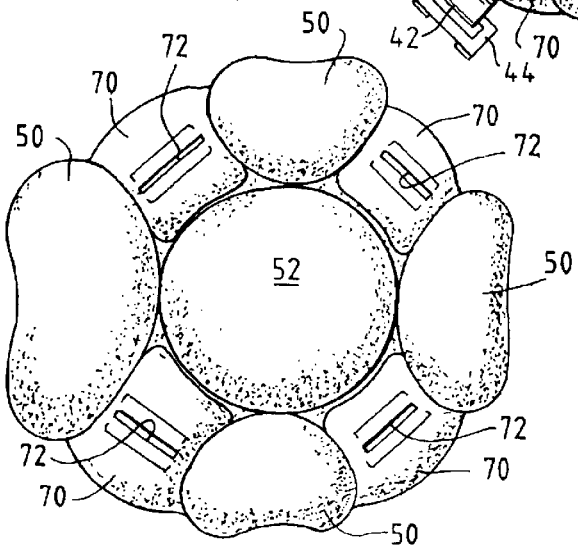
FIG. 3 is an upper, plan view of the array of inflated pads, apart from the firefighter's helmet and apart from the crossed straps.

As illustrated, a firefighter's helmet 10 embodying this invention conforms to the firefighter's helmet disclosed in U.S. Pat. No. 5,121,508, supra, except as illustrated and described herein. The firefighter's helmet 10 has a rigid shell 20 having a lower periphery 22 and has means including a head band 30 mounted within the lower periphery 22, in a manner disclosed therein, and including a suspension system having two crossed straps 40, each of which is attached at its opposite ends 42 to the head band 30, via clips 44, in a manner disclosed therein, for suspending the firefighter's helmet 10 on and securing the firefighter's helmet 10 to a firefighter's head. Whereas the firefighter's helmet disclosed therein has a single pad, which is disposed in a central region within the firefighter's helmet, the firefighter's helmet 10 has an array of inflated pads, which provide cushioning between the suspension system and the wearer's head. Four pads 50 of the array are disposed between the crossed straps 40, between the central region and the lower periphery 22. Said pads 50 may be conveniently called outer pads. Also, another pad 60 of the array is disposed in the central region, beneath the crossed straps 40.

Preferably, each pad 50, 60, comprises a bladder inflated with a suitable gas, such as air, with a suitable liquid, such as water, with a suitable foam, or with a suitable gel, and conforming to the bladder disclosed in U.S. patent application Ser. No. 10/718,276, supra. Thus, each pad 50, 60 is made from two similar, composite sheets joined to each other around a border of said pad 50, 60, each composite sheet having an outer layer made from a flame-resistant fabric and each composite sheet having an inner layer made from a fluid-impervious film.

As illustrated, the fabric sheets 52, 62, not only are joined to each other around a border of each pad 50, 60, but also extend between the outer pads 50 so as to define webs 70 having slits 72, through which the crossed straps 50 extend so as to attach the pads 50, 60, to the crossed straps 40. The fabric sheets 52, 62, may be alternatively attached to the crossed straps 40 via sewing, via rivets or snap fasteners, or otherwise.

While the crossed straps 40 function primarily to fit the firefighter's helmet 10 to the head of a firefighter wearing the firefighter's helmet 10, the pads 50, 60, function primarily to provide cushioning between the crossed straps 40 and the head of the firefighter wearing the firefighter's helmet 10.

What is claimed is:

1. A protective helmet comprising a rigid shell, which has a central region and an outer periphery, a suspension system, which is mounted within the rigid shell and which is adapted to suspend the protective helmet on a wearer's head, and an array of inflatable pads, which are carried by the suspension system, between the central region and the outer periphery, which are joined by a fabric sheet, and which are adapted to provide cushioning between the suspension system and the wearer's head.

2. The protective helmet of claim 1, wherein the suspension system comprises straps mounted within the rigid shell, at spaced intervals around a lower periphery of the rigid shell, each strap extending downwardly and outwardly toward the outer periphery and extending oppositely toward a central region within the rigid shell, and wherein the array of inflatable pads includes pads disposed between the straps, between the central region and the lower periphery.

3. The protective helmet of claim 2, wherein the straps extend through slits in the fabric sheet.

4. The protective helmet of claim 1, wherein the fabric sheet is one of two fabric sheets, by and between which the inflatable pads are joined.

5. The protective helmet of claim 2, wherein the fabric sheet is one of two fabric sheets, by and between which the inflatable pads are joined, and wherein the straps extend through slits in the fabric sheets.

6. The protective helmet of claim 4, wherein the straps extend through slits in the fabric sheets.

7. The protective helmet of claim 1, wherein the inflatable pads include a pad disposed in the central region.

8. The protective helmet of claim 1, wherein the pads are disposed directly below the straps.

9. The protective helmet of any preceding claim, wherein each pad contains an inflated bladder.

* * * * *